US007121850B2

(12) United States Patent
Yeh

(10) Patent No.: US 7,121,850 B2
(45) Date of Patent: Oct. 17, 2006

(54) DUAL-PURPOSE MALE/FEMALE CONNECTOR

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 0 days.

(21) Appl. No.: 10/981,595

(22) Filed: Nov. 5, 2004

(65) Prior Publication Data

US 2006/0099840 A1 May 11, 2006

(51) Int. Cl.
*H01R 13/44* (2006.01)
*H01R 29/00* (2006.01)

(52) U.S. Cl. ..... 439/131; 439/171

(58) Field of Classification Search ..... 439/131, 439/171, 172, 176, 173–175
See application file for complete search history.

(56) References Cited

U.S. PATENT DOCUMENTS 2,159,545 A * 5/1939 Welfgang ..... 384/215
2,538,296 A * 1/1951 Crocker ..... 439/172
3,025,486 A * 3/1962 Falconer ..... 439/103
3,733,576 A * 5/1973 Cooper ..... 439/103
4,592,614 A * 6/1986 Myers, Jr. ..... 439/404
4,626,052 A * 12/1986 Rumble ..... 439/173
D295,622 S * 5/1988 Good et al. ..... D13/137.3
4,755,148 A * 7/1988 Martens ..... 439/166
4,981,438 A * 1/1991 Bekhiet ..... 439/76.1
5,159,545 A * 10/1992 Lee ..... 363/146
5,295,845 A * 3/1994 Changxing ..... 439/173
5,791,921 A * 8/1998 Lee ..... 439/172
6,139,341 A * 10/2000 Hun ..... 439/172
6,231,361 B1 * 5/2001 Ko et al. ..... 439/172
6,419,504 B1 * 7/2002 Nelson ..... 439/103
6,424,522 B1 * 7/2002 Lin et al. ..... 361/683
6,480,390 B1 * 11/2002 Matsumiya et al. ..... 361/736
6,567,273 B1 * 5/2003 Liu et al. ..... 361/737
6,612,853 B1 * 9/2003 Wu ..... 439/136
6,676,419 B1 * 1/2004 Lin et al. ..... 439/76.1
6,738,856 B1 * 5/2004 Milley et al. ..... 710/315
6,743,030 B1 * 6/2004 Lin et al. ..... 439/131
6,808,400 B1 * 10/2004 Tu ..... 439/131
6,908,038 B1 * 6/2005 Le ..... 235/492
7,001,192 B1 * 2/2006 Yeh ..... 439/131
2004/0074264 A1 * 4/2004 Kung et al. ..... 70/58
2004/0087213 A1 * 5/2004 Kao ..... 439/638
2004/0090751 A1 * 5/2004 Choi et al. ..... 361/726
2004/0175976 A1 * 9/2004 Park ..... 439/176
2004/0212966 A1 * 10/2004 Fisher et al. ..... 439/176
2005/0009404 A1 * 1/2005 Lee ..... 439/638
2005/0130468 A1 * 6/2005 Regen et al. ..... 439/131
2005/0164532 A1 * 7/2005 Ni et al. ..... 439/79
2006/0052001 A1 * 3/2006 Parker ..... 439/358
2006/0073717 A1 * 4/2006 Ng et al. ..... 439/131

* cited by examiner

*Primary Examiner*—Gary F. Paumen
*Assistant Examiner*—Larisa Tsukerman
(74) *Attorney, Agent, or Firm*—Troxell Law Office, PLLC

(57) ABSTRACT

A dual-purpose male/female connector is disclosed. A push button for controlling a terminal base, which is mounted in a USB female socket and includes a connection terminal, to enable the terminal base to extend from or draw back in the female socket is mounted on the USB female socket. When the push button is in an unpushing position the connector forms the USB female socket, and when the push button is pushed the terminal base extends from the insulating frame so as to form a USB male plug.

5 Claims, 6 Drawing Sheets

DUAL-PURPOSE MALE/FEMALE CONNECTOR

BACKGROUND OF THE INVENTION

The present invention relates to a dual-purpose male/female connector that can be randomly changed into a male plug or a female socket, and this connector can be applied to various wires, terminals, conversion terminals, conversion wires, terminals of the related apparatus, or the likes.

Universal Serial Bus (USB) connector nowadays is commonly utilized for data transmission. There are many computers and peripheral apparatuses, such as scanner, digital camera, removable hard disk, etc, apply this kind of specification to an interface of a transmission terminal. The USB connector provides with the advantage of unifying connectors that have various specifications so as to overcome the conventional drawback of providing a specific connector for a specific apparatus. The USB connector integrates functions of various connectors with one another. Therefore, the transmission speed, installation, and maintenance of the USB connector are better than that of the conventional singular connector that includes a connection interface, for example, COM 1, COM 2, LPT, or the like.

Most of the general computer hosts provide two USB female sockets. The signal input end of the peripheral apparatus, for example, the scanner, connects to the computer host via a connection wire that has connectors mounted on two sides thereof. The end of the connection wire that couples with the computer host is a USB male plug for plugging into the USB female socket so as to transmit signal.

Nevertheless, the USB connectors must be subdivided into the female socket and the male plug, which are mounted respectively on the computer host and various peripheral apparatuses or two ends of the connection wire, even though the utility rate of the USB connector is very high.

A dual-purpose male/female connector that can be randomly changed into a female socket or a male plug is disclosed in view of the aforementioned circumstances so as to unify the specifications of the connectors that mount on various peripheral apparatuses and connection wires. It is not necessary to subdivide the connector into a female socket or a male plug. Accordingly, the present inventor has been made diligent studies with a quiet mind to design and fabricate a dual-purpose male/female connector. This connector is provided for the consumer in accordance with motivations of the present invention.

SUMMARY OF THE INVENTION

The main purpose of the present invention is to provide a dual-purpose male/female connector that can be randomly changed depending on external computer environment.

Another purpose of the present invention is to provide a dual-purpose male/female connector that has a unified specification.

According to the aforementioned purposes of the present invention, a dual-purpose male/female connector is disclosed. In the present invention, a push button for controlling a terminal base, which is mounted in a USB female socket and includes a connection terminal, to enable the terminal base to extend from or draw back in the female socket is mounted on the USB female socket. As a result, when the push button is in an unpushing position the connector forms the USB female socket, and when the push button is pushed the terminal base extends from the insulating frame so as to form a USB male plug.

DETAILED DESCRIPTION OF THE PREFERRED EMBODIMENT

Figure 1:
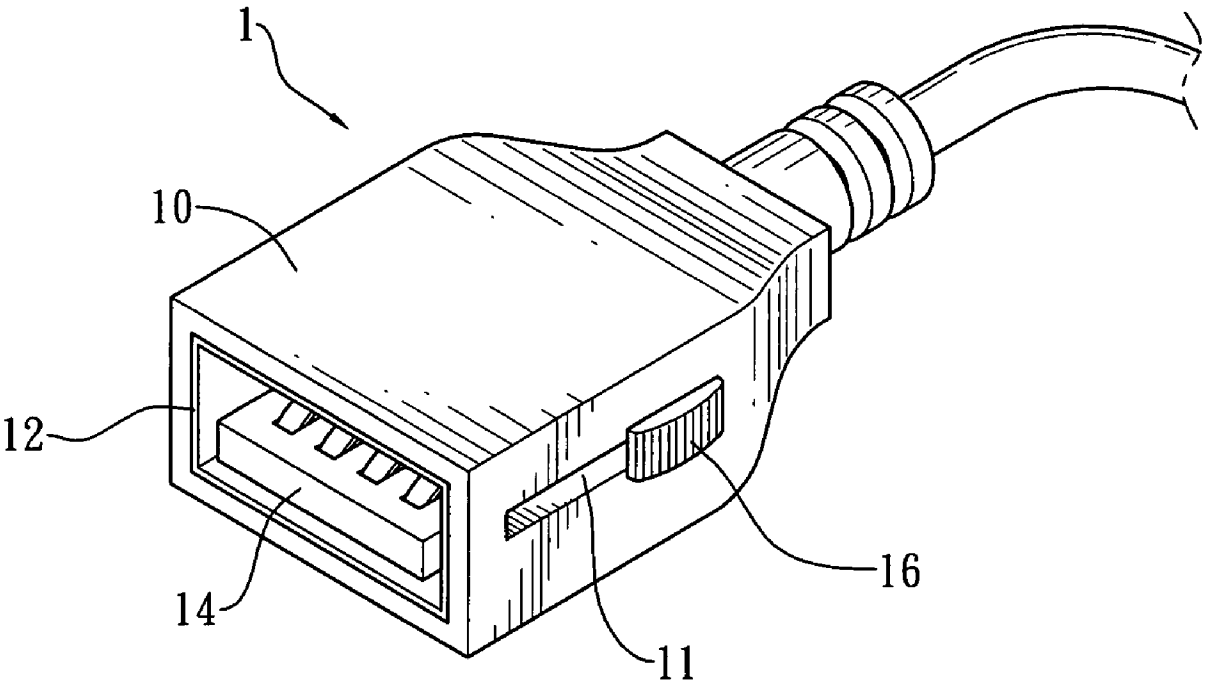
FIG. 1 is a perspective view showing an outward appearance of a preferred embodiment of the present invention.
Figure 2:
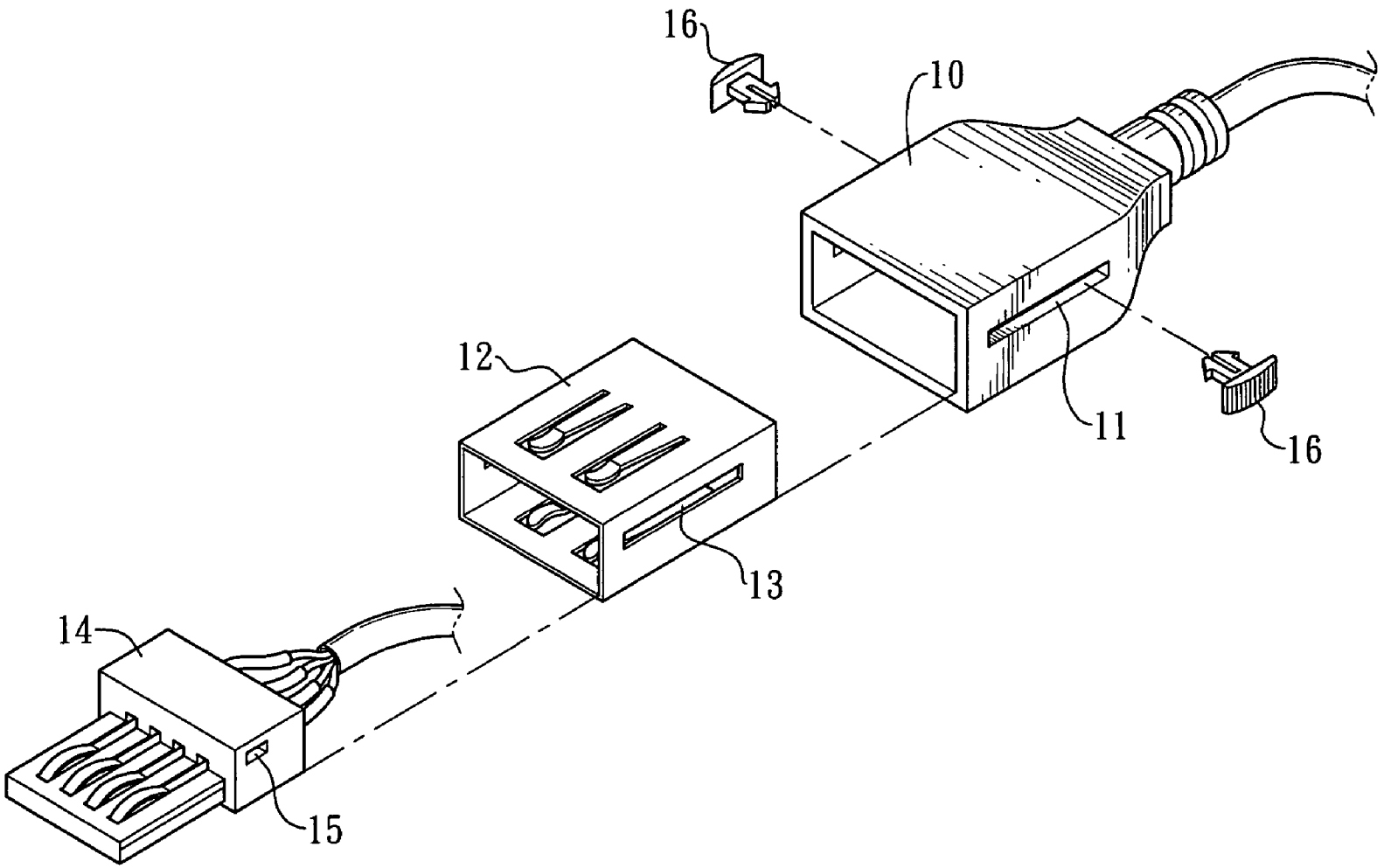
FIG. 2 is a decomposed view showing devices of the preferred embodiment of the present invention.

Referring to FIG. 1 and FIG. 2, the present invention mainly comprises a terminal base 14 having a connection trench 15 mounted thereon. An insulating frame 12 covers the outside of the terminal base 14. A track 13 is mounted in a proper position on the periphery of the insulating frame 12. A plastic housing 10 further covers the insulating frame 12. A track 11 is mounted on the plastic housing 10 in a position corresponding to the track 13 on the insulating frame 12. A push button 16 is mounted in the track 11 and the track 11. The bottom of the push button 16 is coupled with the connection trench 15 of the terminal base 14. As a result, a connector 1 is formed. A USB female connector is formed by drawing back the terminal base 14 of the connector 1 in the insulating frame 12 and the plastic housing 10.

Figure 3:
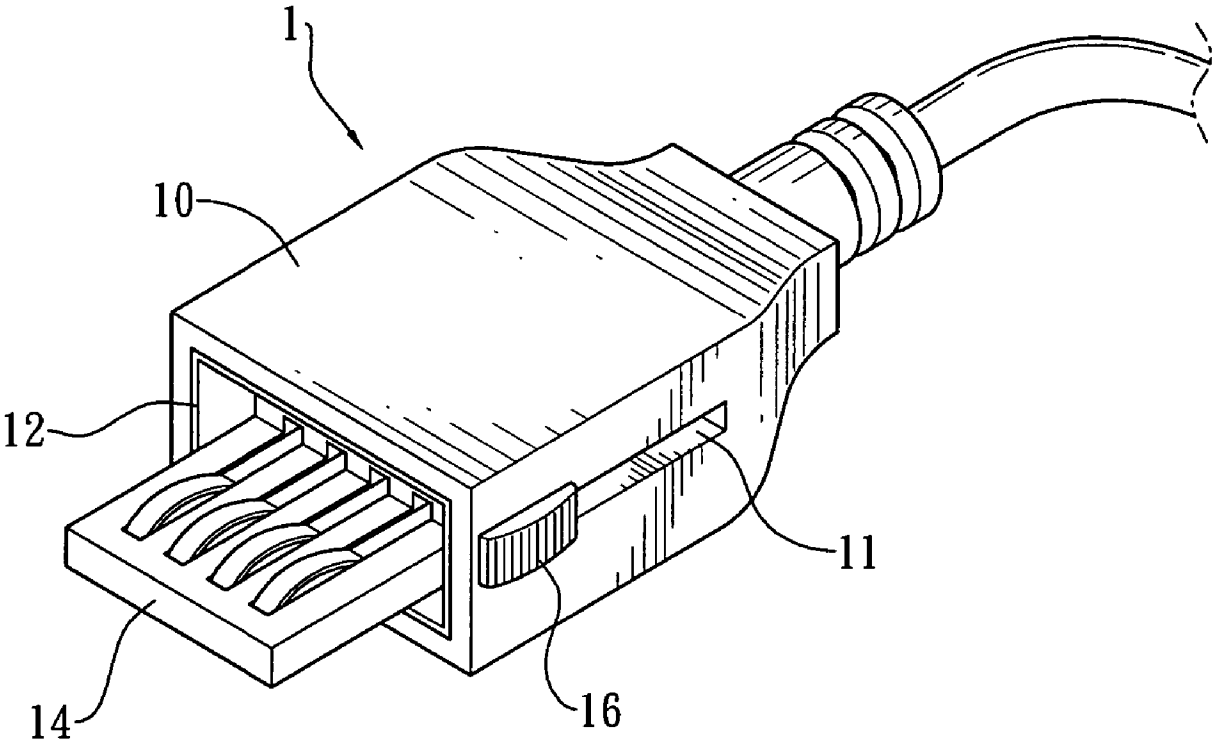
FIG. 3 is a perspective view showing another outward appearance of the preferred embodiment of the present invention.
Figure 4:
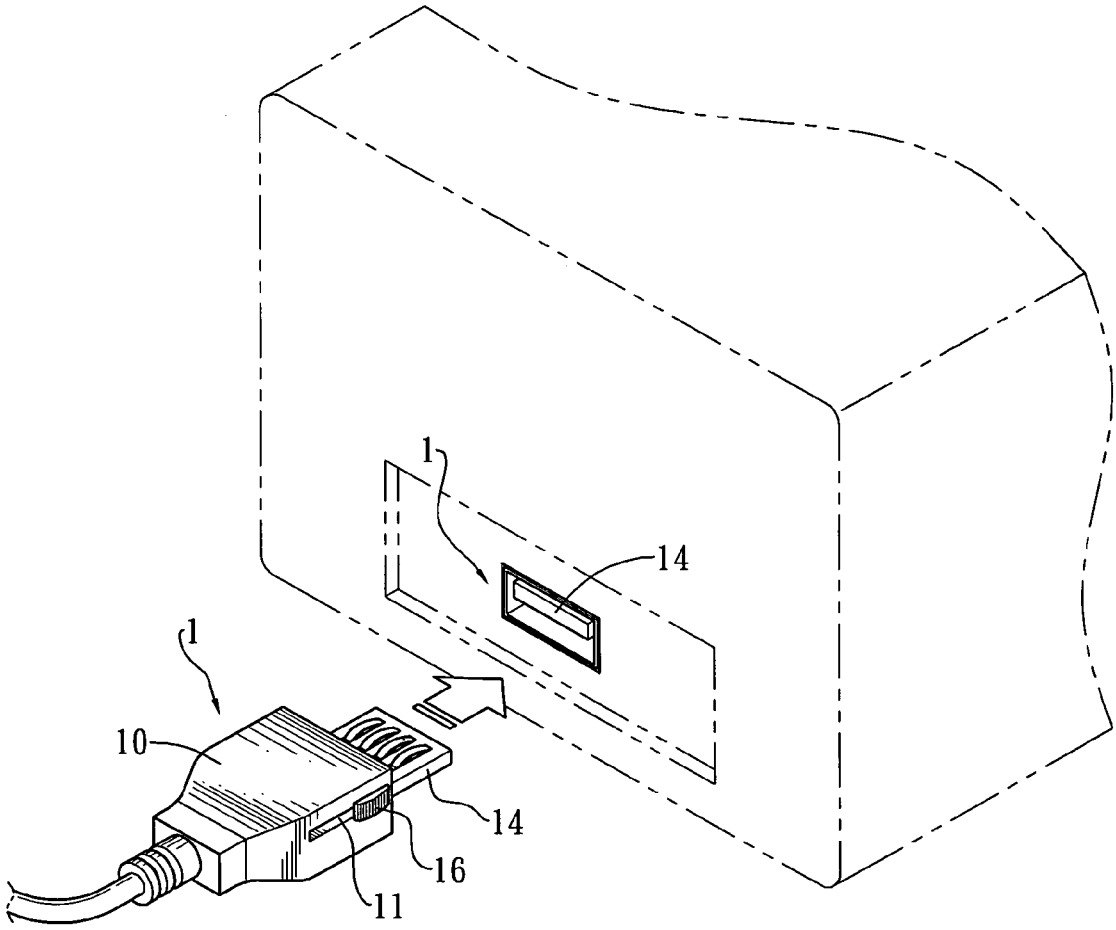
FIG. 4 is a schematic diagram showing usage status of the preferred embodiment of the present invention.

A USB male plug is formed by forwardly pushing the push button 16 of the connector 1 to extend the terminal base 14 from the insulating frame 12 and the plastic housing 10, as shown in FIG. 3. Two connectors 1 are utilized. One of these two connectors 1 is mounted on a computer, wherein the terminal base 14 draws back in the insulating frame 12 and the plastic housing 10. In the other one of these two connectors, the terminal base 14 extends from the insulating frame 12 and the plastic housing 10. Therefore, the connector 1 that includes the extended terminal base 14 can be plugged into the connector 1 that includes the retreated terminal base 14 and mounts on the computer, as shown in FIG. 4. As a result, a singular connector 1 forms the male plug and the female socket so as to couple with one another.

Figure 5:
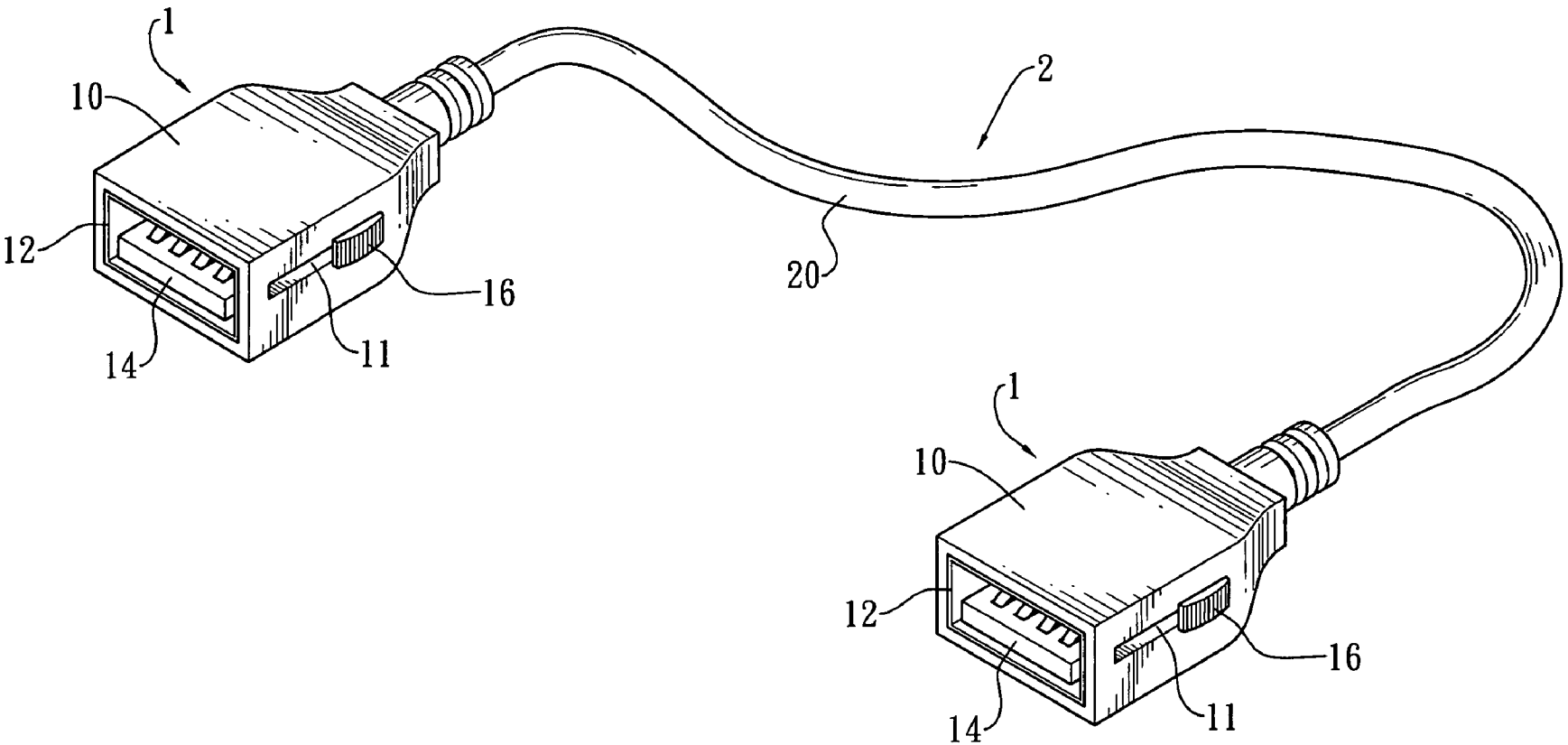
FIG. 5 is a schematic diagram showing an application of the preferred embodiment of the present invention.

Referring to FIG. 5, a preferred embodiment of the present invention is shown. Two connectors 1 are coupled respectively with two ends of a wire 20. As a result, the wire 20 forms a connection wire 2. If connectors of both computer and peripheral apparatus of the computer are USB female sockets, the push button 16 of the connector 1 on two ends of the wire 20 is pushed outwardly to extend the terminal base 14 for connecting the computer with the peripheral apparatus. By pushing the push button 16, the connector 1 provides with four kinds of variation comprising female/female, male/male, female/male, and male/female so as to unify the specifications of the connectors of the connection wire and the peripheral apparatus of the computer. It is not necessary to subdivide the connector into a female socket or a male plug.

Figure 6:
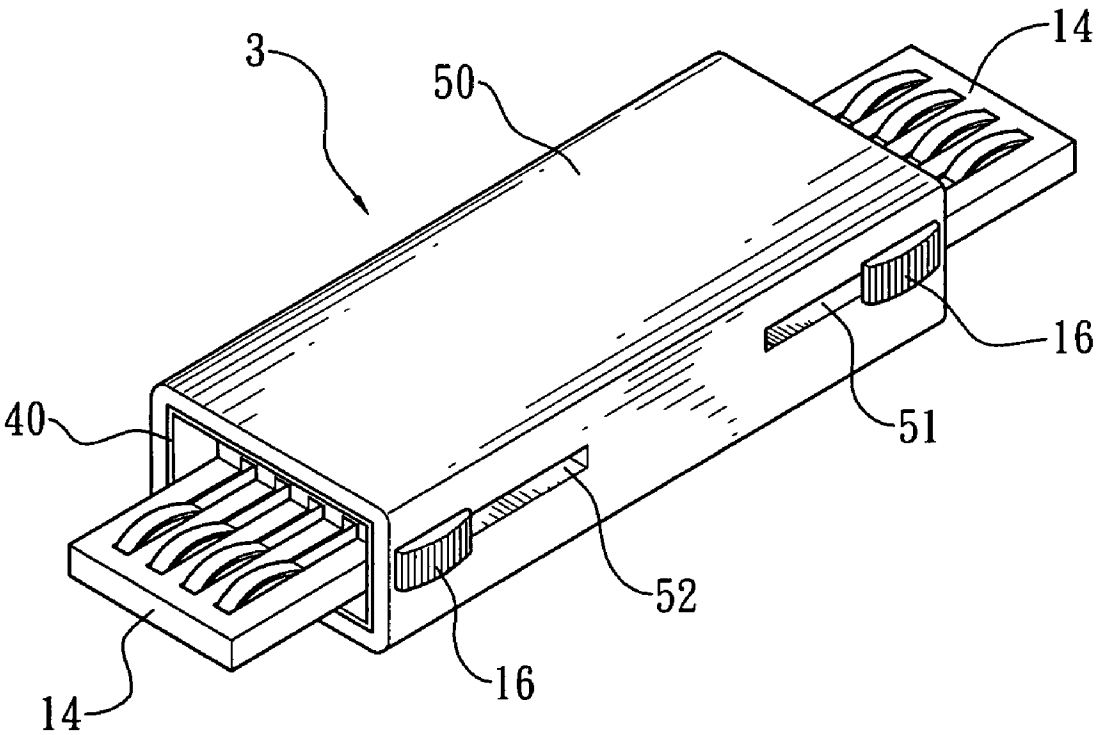
FIG. 6 is a schematic diagram showing another application of the preferred embodiment of the present invention.

Referring to FIG. 6, two terminal bases 14 are coupled with one another in an opposing way. An insulating frame 40 that includes two trenches covers two terminal bases 14. A layer of plastic housing 50 covers the insulating frame 40. The plastic housing 50 provides with two trenches 51 and 52, which are mounted in positions corresponding to two trenches of the insulating frame 40, so as to overlap the trenches 51 and 52 of the plastic housing 50 with the trenches of the insulating frame 40. Two push buttons 16 are mounted respectively in the trenches 51 and 52, wherein bottoms of these two push buttons 16 are coupled with these two terminal bases 14 so as to form an adapter that can be randomly changed into a female socket or a male plug.

However, the above description merely illustrates the preferred embodiments of the present invention, and the applicable scope of the present invention is not limited hereto. Any obvious modification and revision made by a person skilled in the art are included within the spirit and scope of the present invention.

According to the above description, the present invention achieves the expected purposes of the present invention by providing with a dual-purpose male/female connector that is changed depending on the peripheral environment of the computer. The application that complies with utility is therefore submitted for a patent.

The invention claimed is:

1. A dual-purpose male/female connector comprising:

at least one male/female connector assembly having:

a) a housing having at least one housing track;

b) an insulating frame located in the housing and having at least one insulating track, one of the at least one insulating track aligning with each of the at least one housing track;

c) a terminal base slidably inserted into the insulating frame and having at least one connection trench located on a side thereof; and d) at least one push button selectively controlling a movement of the terminal base, one of the at least one push button is inserted through each of the at least one housing track and one of the at least one insulating track, and connected to one of the least one connection trench, wherein the terminal base is movable between first and second positions, in the first position the terminal base is a male USB plug extending outwardly from the housing and in the second position the terminal base is retracted into the housing to forming a female USB plug located within the housing.

2. The dual-purpose male/female connector according to claim 1, wherein the at least one housing track includes two housing tracks located on opposing sides of the housing, the at least one insulating track includes two insulating tracks located on opposing sides of the insulating frame, the at least one connection trench includes two connection trenches located on opposing sides of the terminal base, and the at least one push button includes two push buttons.

3. The dual-purpose male/female connector according to claim 1, wherein the at least one male/female connector assembly includes a first male/female connector assembly and a second male/female connector assembly.

4. The dual-purpose male/female connector according to claim 3, wherein the first male/female connector assembly and a second male/female connector assembly are connected by a wire.

5. The dual-purpose male/female connector according to claim 3, wherein the housing of the first male/female connector assembly is integrally made with the housing of the second male/female connector assembly.

* * * * *